US005109651A

United States Patent [19]

Stuart

[11] Patent Number: 5,109,651

[45] Date of Patent: May 5, 1992

[54] ICE BAGGER

[75] Inventor: James F. Stuart, Houston, Tex.

[73] Assignee: Packaged Ice, Inc., Houston, Tex.

[21] Appl. No.: 593,046

[22] Filed: Oct. 5, 1990

[51] Int. Cl.[5] ..... B65B 5/06; B65B 63/08

[52] U.S. Cl. ..... 53/502; 53/167; 53/573; 62/344

[58] Field of Search ..... 53/502, 167, 384.1, 53/468, 467, 469, 473, 251, 250, 573, 571; 62/344, 60, 135, 340, 377

[56] References Cited

U.S. PATENT DOCUMENTS 3,789,570 2/1974 Mullins, Jr. ..... 53/29
3,807,193 4/1974 McKenney et al. ..... 53/502 X
3,913,343 10/1975 Rowland et al. ..... 62/344 X
4,074,507 2/1978 Ruf et al. ..... 53/502
4,368,608 1/1983 Ray ..... 53/440

OTHER PUBLICATIONS

Hoshizaki Brochues (No Date).

*Primary Examiner*—James F. Coan
*Attorney, Agent, or Firm*—Kenneth H. Johnson

[57] ABSTRACT

An ice bagging apparatus comprising an ice collecting zone, which has water drain, an auger position below and in communication with the ice collecting zone and in communication with a separated ice delivery and bagging zone. The ice delivery and bagging zone has a weight sensing bottom closure, and a tractor with a vacuum surface for grasping and deploying a bag on the closure positioned for receiving ice delivered from the auger. The ice bagging apparatus is combined with an ice making apparatus and a bagged ice storage zone.

32 Claims, 5 Drawing Sheets

ICE BAGGER

BACKGROUND OF THE INVENTION

1. Field of the Invention

The present invention relates to an apparatus for bagging discrete units of ice produced by associated apparatus.

2. Related Art

One of the more recent developments is U.S. Pat. No. 4,368,608 to Ray which discloses an ice bagger where a measured amount of water is frozen, cubed and dropped directly into bag placed under a chute and which is embodied in the Texas Aim, Inc. Ice Bagger.

Although the Ray apparatus is an advance, it has been found to have a number of serious defects which made the apparatus very labor intensive for upkeep and maintenance.

A large amount of the ice is melted during the defrost cycle. When the ice drops responsive to this defrost cycle, all this water is also dropped into the bag of ice. This creates two additional problems: (1) Some of this water leaks out of the air vent hole in the ice bag and runs down into the bottom of the merchandiser where it freezes—over time, depending on the volume of ice produced, this creates a frozen block of ice that must be cleaned out; and (2) The water freezes the ice cubes together so that the bag of packaged ice is a solid block instead of individual cubes. If the bag fails to open for any reason, the ice can be dropped directly into the merchandiser, requiring clean up. The AIM machine transports all the bags each time to the chute to accept the ice. It is difficult to load the bags and they can be easily loaded backwards. If the ice maker false cycles and makes less than a full harvest, then the bag of ice produced is less than the amount printed on the bag. There is no flexibility as to size of the bag of ice since this is controlled by the cuber. The AIM bagger drops the filled bag of ice to the rear of the merchandiser where they may stack improperly causing premature indication of a full merchandiser and machine shut down.

It is an advantage of the present invention that the ice does not drop directly into a bag from the ice making component of the combination. It is a feature of the present invention that the run off water is collected away from the bag and removed from the machine. It is a further advantage of the present invention that false or short cycling of the ice maker will not effect the load delivered to the bag. It is a feature of the present invention that different size or weights of bags of ice may be produced. It is a particular feature of the present invention that bags are more easily loaded and only in the correct alignment. A further advantage of the present invention is that it utilizes the bag storage space more completely. It is a particular feature of the present that the stacking of the bagged ice is more efficiently carried out to achieve balanced distribution of the bagged ice in the merchandiser, thus reducing the likelihood of premature shut down of the system. These and other advantages and features of the present apparatus will become apparent from the following.

SUMMARY OF THE INVENTION

Briefly central embodiment of the present invention is an ice bagging apparatus comprising an ice collecting zone, an ice conveying means position below and in communication with said ice collecting zone and in communication with an ice bagging zone, means to remove water from the collecting zone and transport means, said ice bagging zone having a weight sensing bottom closure, and a means for deploying an open bag on the closure positioned for receiving ice delivered from the conveying means. A further embodiment is the stock bag loading and storage cassette.

In a broader view the present invention is a combination of the described ice bagging apparatus with an ice making apparatus and in a further combination with a bagged ice storage zone.

In a particular embodiment of the present invention there are two ice collecting and conveying means associated with a single ice delivery zone.

In the following description the same elements have been given the same designations. It is of course appreciated the reversal of parts to perform the same function in the same manner is contemplated to be within the scope of the present invention. The illustrative and preferred embodiments depicted herein are not a limitation on the scope of the invention.

DETAILED DESCRIPTION OF A PREFERRED EMBODIMENT

Figure 1:
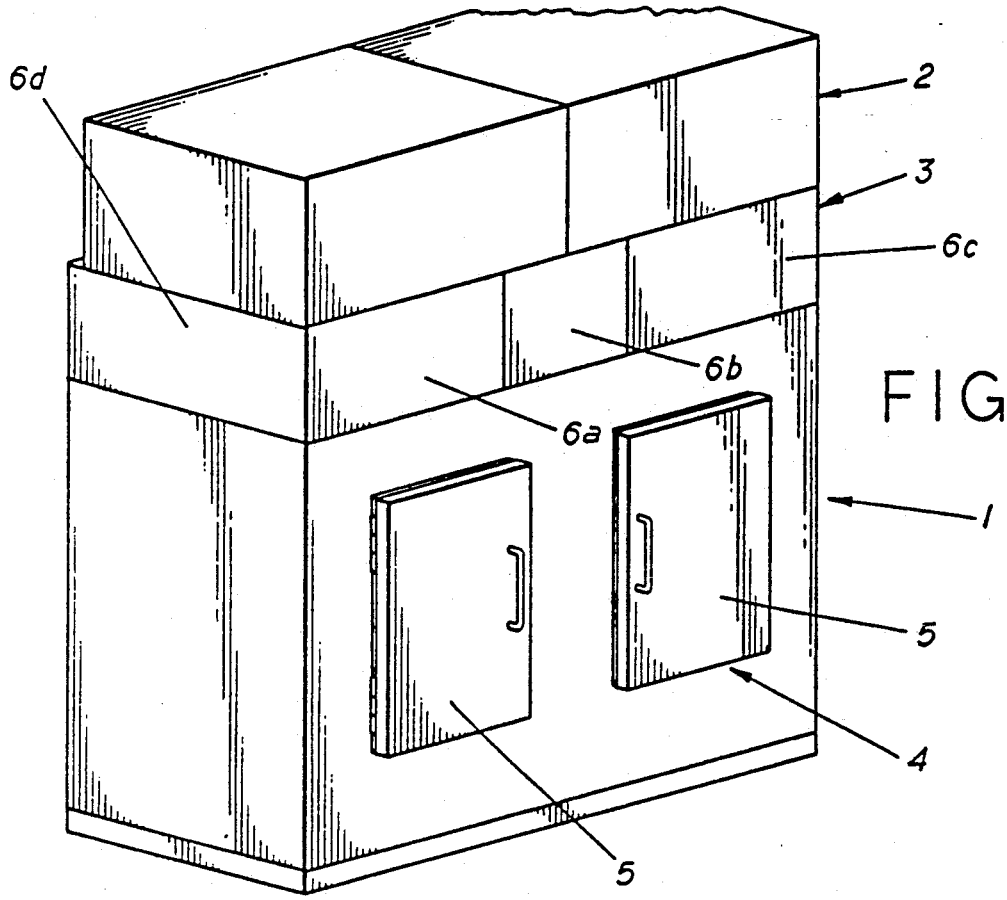
FIG. 1 is an isometric view of one embodiment of a combination of the present invention.

In FIG. 1 a preferred combination of ice manufacturing zone 2, ice collecting and bagging zone 3 and ice storage zone 4 is shown in cabinet 1 with access to the storage area through doors 5.

Referring now to FIG. 1 the ice collecting and bagging zone 3 is shown in two mirror image portions **3*a* and 3*b***.

The ice is collected in collection zones **10*a* and 10*b* which each comprise a funnel 12. The funnel 12 is positioned below an ice maker (not shown). In this apparatus almost any ice maker can be used, so long as it produces discrete units of ice, e.g. of a cube or crescent shape and from ½ to 2½ inches average dimensions. Such a device is HOSHIZAKI KM -1200 manufactured by Hoshizaki America, Inc. Similarly Kold-draft ice making machine described in U.S. Pat. No. 4,368,608 or even chunk or crushed ice can be used. Because of the total isolation of ice collection system from the bagging mechanism and the provision of a drain 24** to remove incidental water from the system, the present invention is not dependent on any particular ice making machine.

Positioned below the funnel 12 is upwardly inclined tube 14 in which auger 16 is positioned. The auger is mounted at its lower end in bushing 18 in removable closure 100. Also located at the lower end of the auger tube is drain 24 which is attached by threadably engaging the end of the drain into the tube 14 and tightening a nut 22 against the tube (see FIG. 4). The drain is at substantially the lowest point in the ice collection zones 10*a* and 10*b*, hence any incidental water is quickly removed via line 24.

Figure 2:
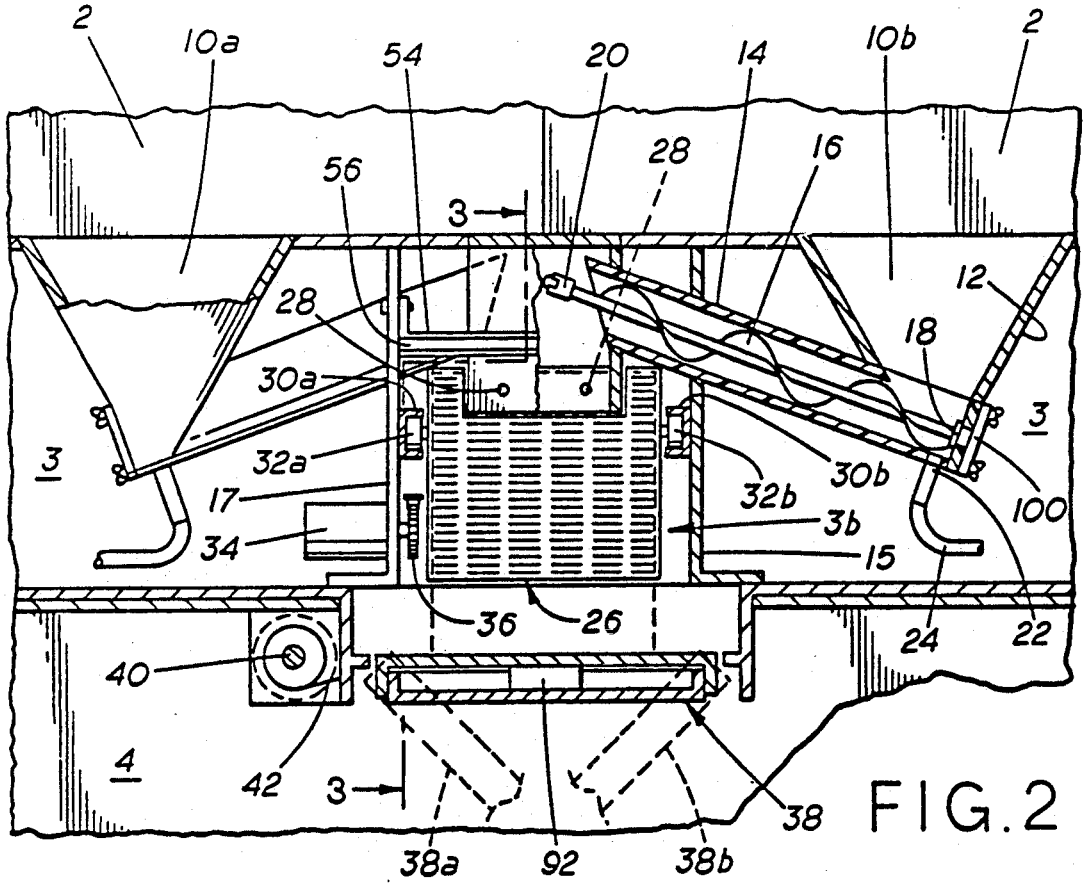
FIG. 2 is a front elevational cross sectional view of a bagger embodiment of the present invention.

Considering FIG. 2 the auger is driven through shaft 46 and universal joint 20 by motor 44 and is rotated to move ice cubes, for instance (not shown) up the tube 14 and out through mouth 15 where it falls on to the inclined surface 74. As the ice moves up the tube more water is drained off, thus the ice that is bagged and merchandised is "Dry Ice TM".

A tractor 26 is mounted in the bagging zone generally shown as 3*b*. In this preferred embodiment there are two ice making machines (not shown) two mirror image ice collecting zones 10*a* and one centrally located ice bagging zone 3*b*. The tractor 26 is rollably mounted on wheels 32*a* and 32*b* which move in tracks 30*a* and 30*b*, respectively. The travel and positioning of the tractor 26 is preferably controlled by appropriately positioned proximity switches (not shown).

Figure 3:
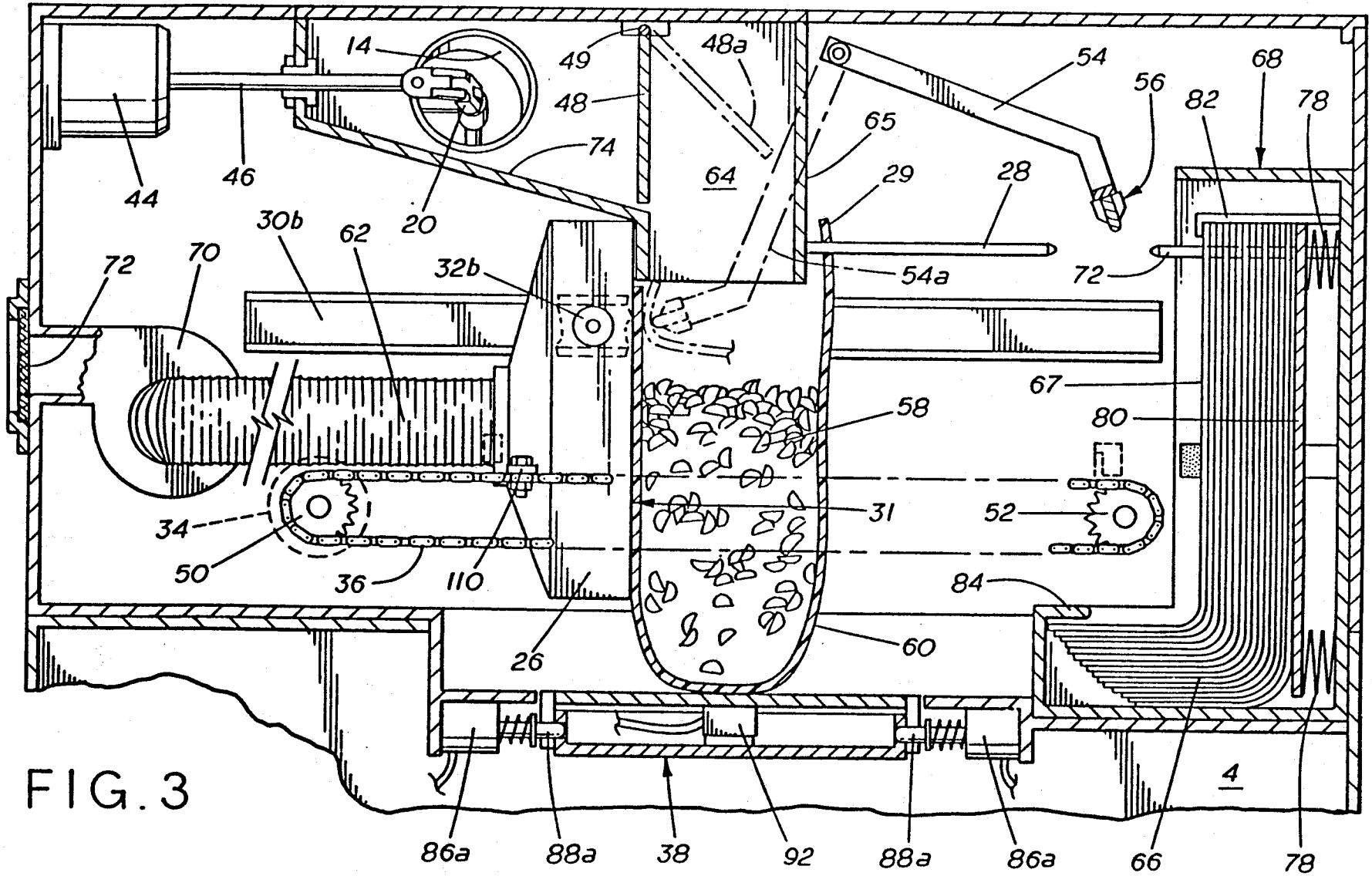
FIG. 3 is a cross-sectional view along lines 3—3 of FIG. 1.
Figure 6:
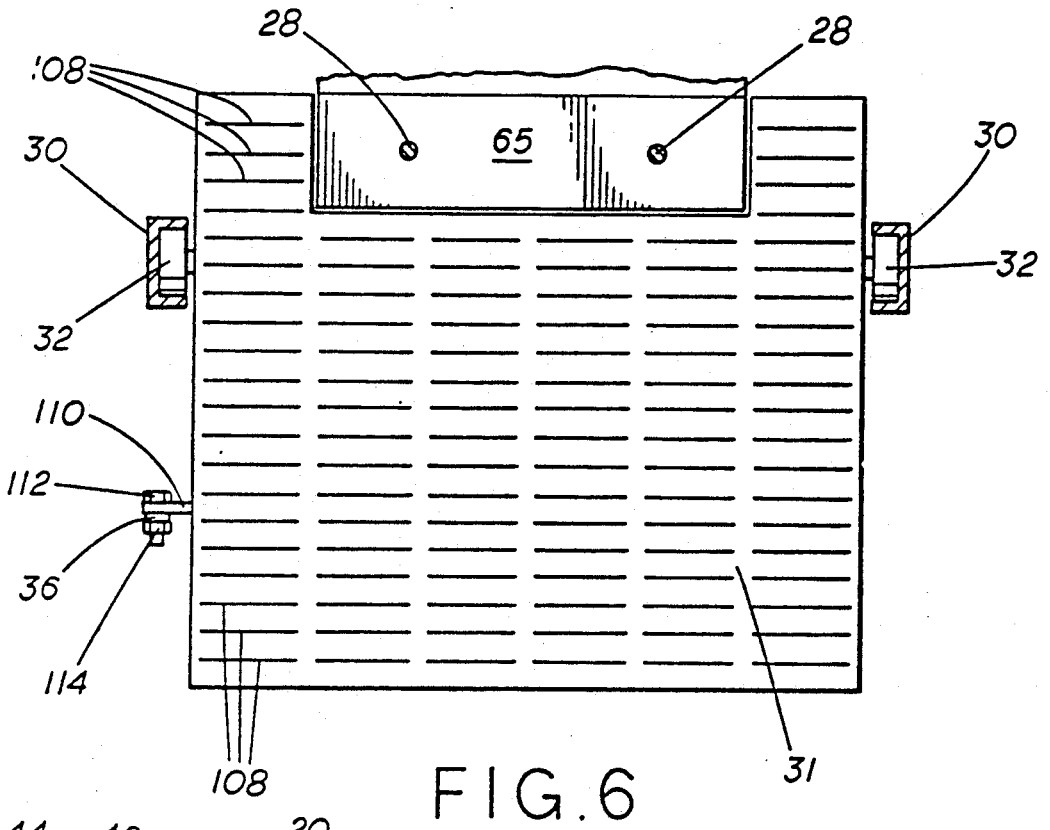
FIG. 6 is a front elevational view of a portion of the bag deployment means.

The tractor 26 is moved by motor 34 which is mounted to wall 17 and drives chain 36. In FIG. 3 track 30*b* is shown to extend across the central portion of wall 15 so as to enable the tractor to move along the tracks 30*a* and 30*b* a point where it will contact the first bag 67 in the stored bags 66 in removable bag cassette 68. The chain drive 36 passes around free wheeling gear 52 and is driven by gear 50 mounted to the motor 44. The chain is attached to the tractor by a bolt 112 through bracket 110 which is affixed on the tractor and attached to the chain drive through a link by nut 114 (see FIG. 6).

In FIG. 3 the bagging zone 3*b* is shown in the loaded mode. A bag 60 is shown deployed against tractor 26 on one side and positioned on pin 28 (there are two pins 28) on the other. Swing gate 48 is pivotally mounted at 49 to check the flow of ice from inclined surface 74 and directs the ice into the central portion of the deployed bag 60. Ice 58 has been delivered from the collection zone 10*a* by the auger 16 and the bag is filled by a predetermined weight sensed by strain gage 92.

The sensing of the filled bag shuts down the auger(s) and actuates the arm 54 to move into the position shown by phantom lines 54*a*. Heat sealing element 56 is mounted at the distal end of the arm 54 and seals the two sides of the bag together when in the 54*a* position. The arm 54 is conveniently driven by a motor (not shown).

Figure 8:
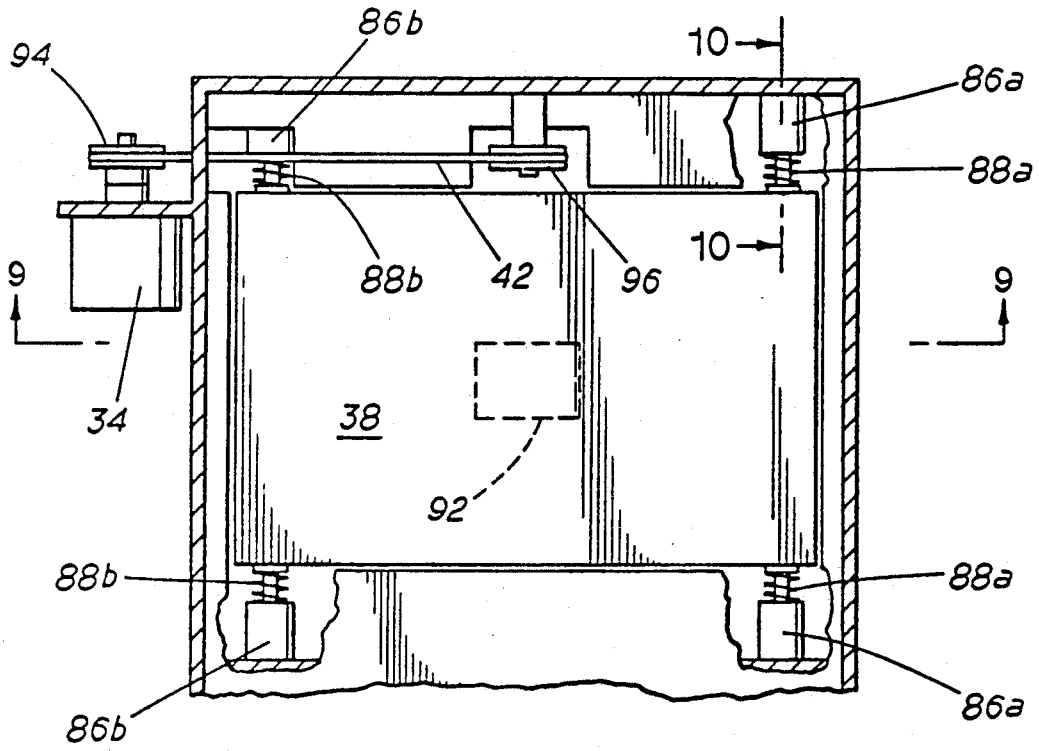
FIG. 8 is an in plan view of the weight sensing closure on which the deployed bag rest while filing.
Figure 9:
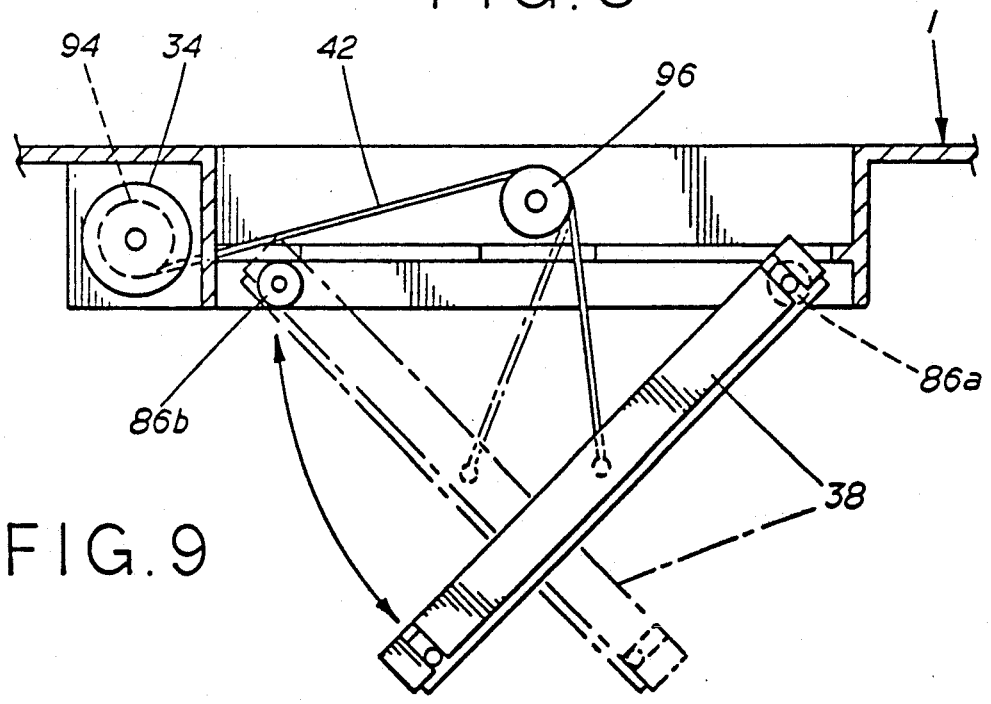
FIG. 9 is a cross-sectional view along line 9—9 of FIG. 8.
Figure 10:
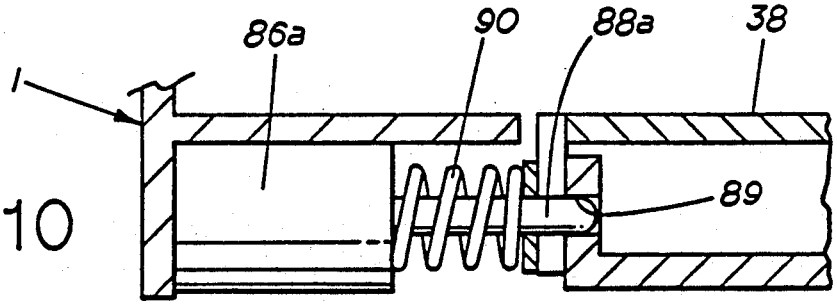
FIG. 10 is an enlarged partial view along line 10—10 of FIG. 8.

After the functioning of the heat sealer 56 and it returns from the 56*a* position, the bag is presumed sealed and the weight sensing closure 38 is sequenced to opened and drop the filled, sealed bag of ice into the storage area 4. The operation of closure 38 is best seen from FIGS. 8, 9 and 10. Prior to activation the closure is held in place by metal pins 88, actually four pins in two sets of a and b each. The pins 88*a* and 88*b* are each operably part of solenoids 86*a* (2 each) and 86*b* (two each). In the off mode the four pins are extended by springs 90 and seat into bores 89 located generally on the lateral surface of the closure at each end with each set 86*a*—*a* and 86*b*—*b* being apposed and mounted in the cabinet along the sane axis, such that each pair of pins 88*a*—*a* and 88*b*—*b* forms a pivot or axle about which the closure can rotate.

After the sealing of the bag one of the two sets of solenoids 86*a*—*a* or 86*b*—*b* is actuated thereby withdrawing the respective pins and freeing the closure to rotate about the other set of pins and to drop the filled, sealed bag of ice into the one side of the storage area. The closure 38 is attached to cord 42 which is attached to spring loaded pulley 94 (coil spring 40) over pulley 96 which pulls the closure back up into the closed position after the bag has fallen off. The closure depress the pins 88*b* until the bores 89 align therewith and the pins are biased into the bores locking the closure in place.

A counter (not shown) alternates the activation of the solenoid sets, thereby dumping the bag of ice into alternating sections of storage zone 4 of the cabinet 1.

Figure 4:
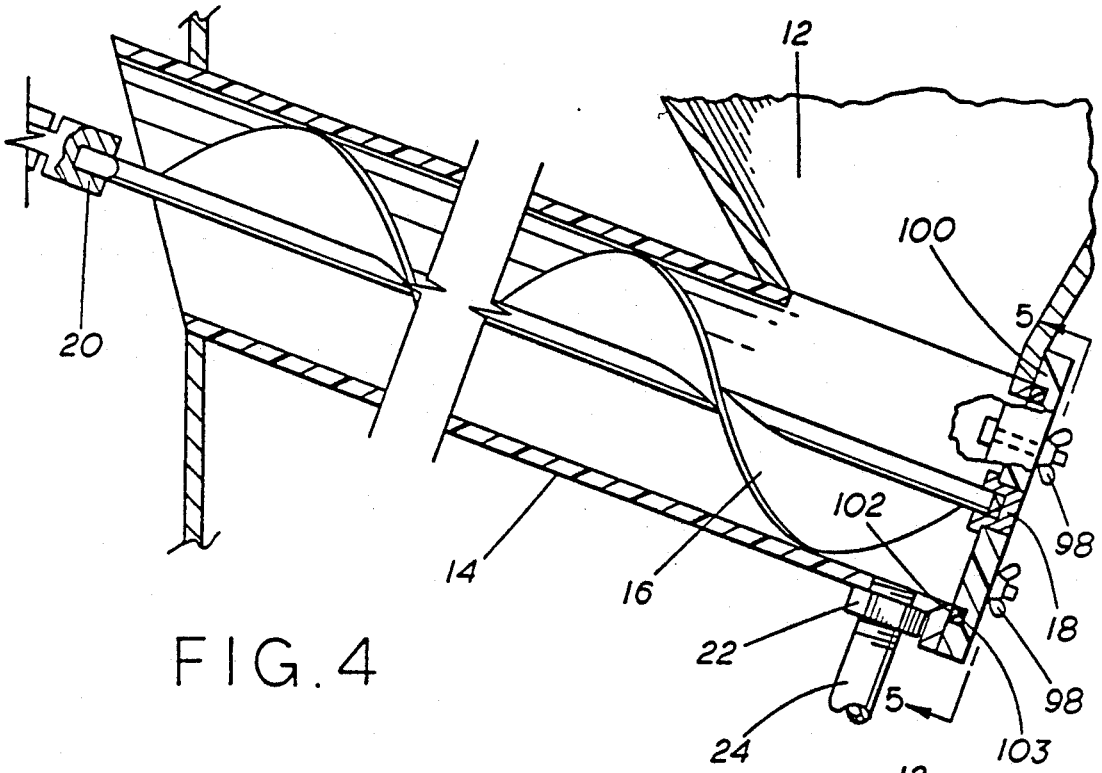
FIG. 4 is a detail cross-sectional view of one embodiment of the ice transport mechanism.
Figure 5:
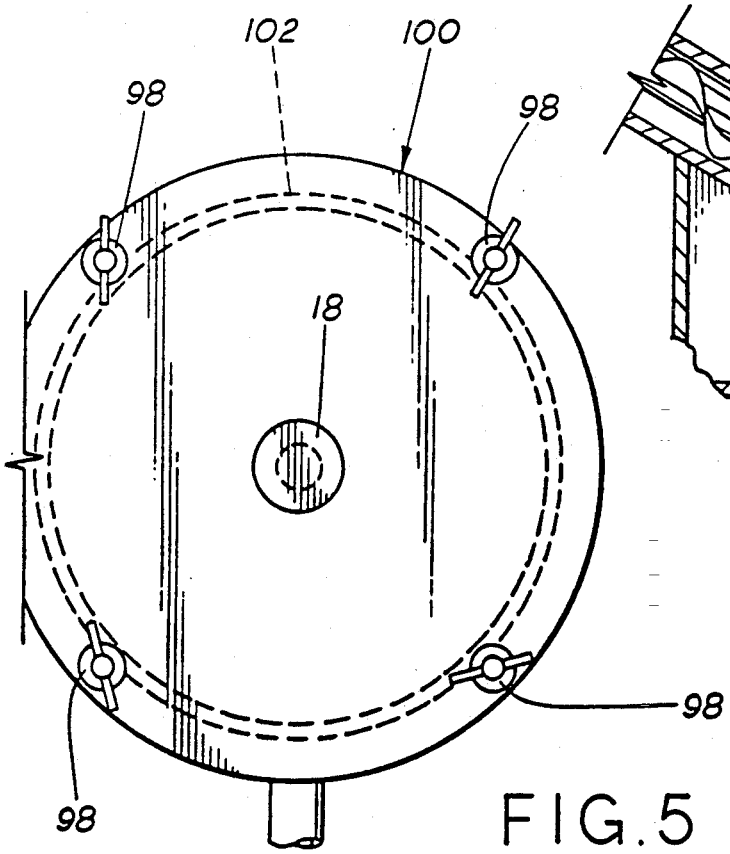
FIG. 5 is an in plan view on line 5—5 of FIG. 4.

Referring now to FIGS. 4 and 5, in the embodiment shown in FIG. 1 the auger 16 is driven from the upper end and mounted in the bushing 18 in closure 100. The closure 100 is removable and held in place by four wing ruts 98. A seal or gasket 102 is seated in a groove 103.

Figure 7:
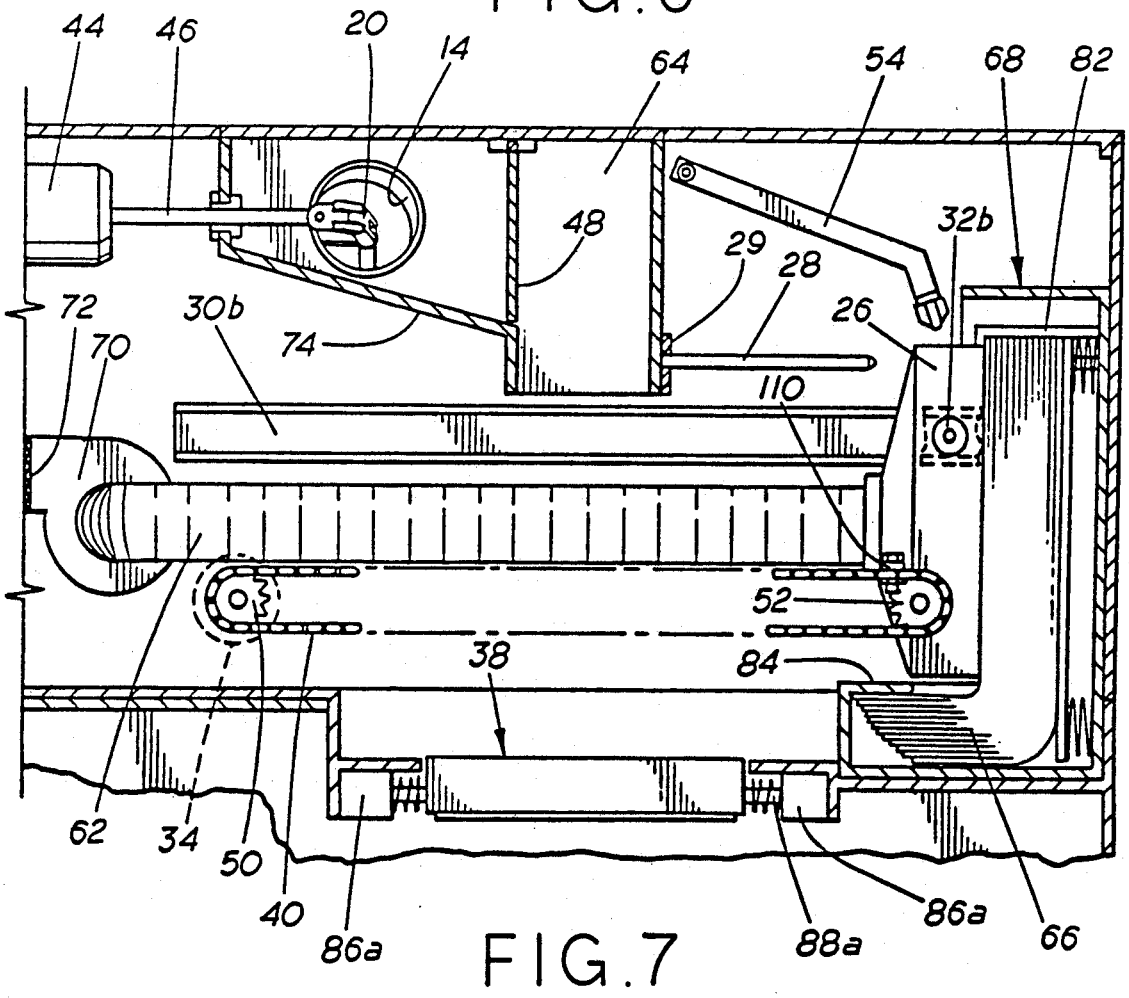
FIG. 7 is an elevational cross-sectional view of the bag deployment mechanism.

The bag 60 was deployed on to pin(s) 28 by the tractor 26 moving forward to a position as shown in FIG. 7 where a proximity switch (not shown) actuates the exhaust fan 70 or vacuum pump 70 and connected to the tractor by flexible hose 62 through vent 72 thereby causing a suction in the face 31 of the tractor through the slots 108 causing the first bag in cassette 68 to be grasped. The tractor then retreats along track 30*b*, pulled by reversal of motor 34. As the tractor retreats to the position shown in FIG. 3 the first bag 67 is removed from cassette 68, from pin(s) 78. The pins 78 are aligned with pins 28 so that as the tractor retreats the bag is hung on pins 28 by holes in the bags on which they were stored in the cassette. The finger 82 retains the other bags and the first bag is pulled out of the cassette and away from toe 84.

As the tractor proceeds to its at rest position, preferably controlled by a proximity switch (not shown), one side of the bag which is mounted on pins 28 stops and the other side held fast to the tractor by suction continues on to the far side of chute 64. The pins 28 are mounted on to chute member 65 and reinforced by bracket 29. The bag is now deployed and ready to receive ice as described above. This sequence is repeated until the storage area is filled, the bag supply is exhausted or the cycling is terminated by some other means.

A particular feature of the present apparatus is the removable bag cassette 68. The bags 66 are positioned on the pin(s) 72 and pressed down against the rigid back plate 80. The springs 78 bias the bags so that the first bag is always in the same position for retrieval by the tractor. After the bags are loaded and inspected in the cassette, the cassette is merely replaced through panel 6*b* and latched (not shown) in place.

The panels 6*a*–*d* are provided for cleaning, repair and serving of the ice bagger.

Figure 11:
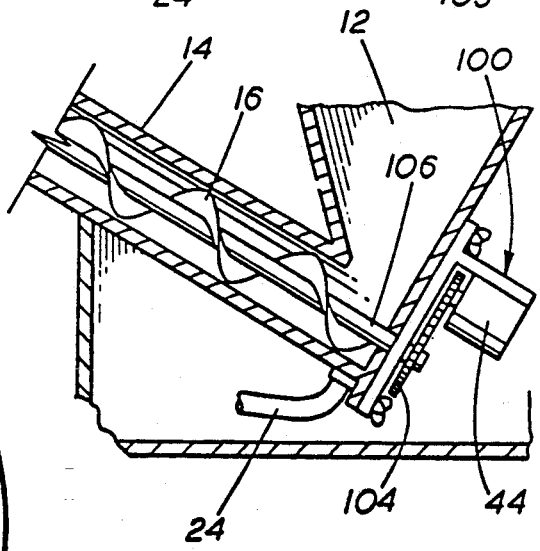
FIG. 11 is partial cross-sectional view of an alternative ice transport means embodiment.

FIG. 11 shows alternative auger arrangement. The auger shaft 106 extend through the closure 100 on which the motor 44 is mounted and is driven by belt 104 or by direct gear drive (not shown). The auger may lie in the tube 14 or it can seat in a bushing (not shown) in the ice collecting zone 10*a* or 10*b*.

In a typical cycle the bagger operation is activated by the ice cuber. When the ice machine has completely frozen the water, the cuber will start the harvest cycle by activating the defrost cycle. When the cuber starts the defrost cycle, this activates the start of the bagging operation as follows:

The tractor is activated and it moves forward to the first bag. A proximity switch stops the forward travel as the tractor makes contact with the first bag. The vacuum pump is activated and attaches the tractor firmly to the first bag. With the vacuum remaining on, the tractor reverses and returns to the resting position where the bag will be pulled open under the chute. The tractor will hit a backstop proximity switch where it stops. This will then activate the auger. The auger will remain on until the bag has been filled to the predetermined weight. When this weight is reached, the strain gauge or load cell will activate a switch to turn the auger off and also turn the vacuum off. With the auger off and the vacuum off, the heat seal motor will be activated. The heat seal bar will rotate down and compress the back of the bag against the front of the bag. Then, the impulse heater is activated to a predetermined time/temperature. The bag is sealed, then the heat seal bar returns to its resting position. This activates the drop door.

The drop door will lower either on the left side or right side depending on the last cycle. It alternates, one time dropping to the left, next time to the right. Once the drop door returns to the rest position, this will activate the tractor to start the next bag to be cycled. After the last bag in a given ice harvest cycle is filled, the bagger is ready to start the whole cycle over with the other cuber. If the first cuber were to cycle "harvest" at the same time as the second cuber or before the second cycle has been completed, it will not start because two augers cannot operate at the same, as it will be held out by the control circuit. If the drop door does not return to the rest position in the designated time, the control circuit will turn the cuber off and shut the machine down. The drop door may stop in the downward part of the cycle or the upward part of the cycle. The most probable reason for it stopping is that it is restricted by another bag of ice. This means the merchandiser is full of ice, hence the "full bin" will turn the whole system off.

A "full bin" probe will also be located in the hopper that would also act as a safety in case of other failure where the cuber continued to make ice. This would also shut the system down. If the failure of the drop door to return to the rest position shuts the system off before all bags of a cycle have been bagged, then a heater/fan will come on in the hopper and any remaining ice will melt and simply run down the drain. A proximity switch will also shut the system down if it is out of bags (out of bag switch). Another proximity switch will shut the system down if it has a bag but the bag failed to open properly under the chute. The various proximity switches, probes, heaters, fans and the like are not shown in the drawing, however, they are conventional and their placement and necessary circuitry to connect to a controller, e.g., microprocessor to carry out their functions is readily achieved from the foregoing description of apparatus and function.

I claim:

1. An ice bagging apparatus comprising:
(a) an ice collecting zone comprising a funnel shaped structure;
(b) an upwardly directional ice transport means operably positioned at substantially the lowest portion of said ice collecting zone and
(c) an ice bagging zone comprising a weight sensing closure and positioned below an upper terminal end of said ice transport means and a tractor movably positioned in said bagging zone between an upper terminal end of said ice transport means and said weight sensing closure, said tractor having a suction surface, alignable with a supply of bags for grasping and deploying a bag on said closure and below said upper terminal end.

2. In combination:
(a) an ice making machine;
(b) an ice bagging apparatus comprising:
(i) an ice collecting zone,
(ii) an upwardly directional ice transport means operably positioned at substantially the lowest portion of said ice collecting zone and
(iii) an ice bagging zone positioned below an upper terminal end of said ice transport means; and
(c) a bag storage compartment and
(d) a second ice collecting zone and a second upwardly directional ice transport means operably positioned at substantially the lowest portion of said second ice collecting zone, wherein an upper terminal end of the second ice transport means is positioned above said ice bagging zone.

3. An ice bagging apparatus comprising:
(a) an ice collecting zone;
(b) an upwardly directional ice transport means operably positioned at substantially the lowest portion of said ice collecting zone and
(c) an ice bagging zone comprising a weight sensing closure and positioned below an upper terminal end of said ice transport means wherein said weight sensing closure comprises a platform having two opposed sides, each side having means for lowering it exclusive of the other side.

4. An ice bagging apparatus comprising:
(a) an ice collecting zone;
(b) an upwardly directional ice transport means operably positioned at substantially the lowest portion of said ice collecting zone and
(c) an ice bagging zone comprising a weight sensing closure and positioned below an upper terminal end of said ice transport means wherein said weight sensing closure comprises a platform, two sets of opposed bores located along opposed edges of said platform, two sets of opposed retractable pins extending into said bores, each set of said retractable pins being operably associated to be simultaneously retractable exclusive of the other set of retractable pins.

5. An ice bagging apparatus comprising:
(a) an ice collecting zone comprising a funnel shaped structure;
(b) an upwardly directional ice transport means comprising an upwardly inclined tube;
(c) an ice bagging zone positioned below an upper terminal end of said ice transport means; and
(d) a water drained positioned on said tube at substantially the lowest point thereof.

6. An ice bagging apparatus comprising:
(a) an ice collecting zone;
(b) an upwardly directional ice transport means comprising an upwardly inclined tube; and
(c) an ice bagging zone positioned below an upper terminal end of said ice transport means; and
(d) a water drain positioned on said tube at substantially the lowest point thereof.

7. An ice bagging apparatus comprising:
(a) an ice collecting zone comprising a funnel shaped structure;
(b) an upwardly directional ice transport means comprising an upwardly inclined tube and an auger positioned in said tube along the axis thereof, said auger being driven by a motor, said transport means being operably positioned at substantially the lowest portion of said ice collecting zone;
(c) an ice bagging zone positioned below an upper terminal end of said ice transport means and
(d) a water drain positioned on said tube at substantially the lowest point thereof.

8. The ice bagging apparatus according to claim 7 wherein said funnel and said tube are connected.

9. The ice bagging apparatus according to claim 8 wherein said tube terminates in said bagging zone.

10. The ice bagging apparatus according to claim 9 wherein said motor is positioned at the upper end of said auger.

11. The ice bagging apparatus according to claim 9 wherein said motor is positioned at the lower end of said auger.

12. The ice bagging apparatus according to claim 9 wherein a removable closure is positioned at the lower end of said tube.

13. An ice bagging apparatus comprising:
(a) an ice collecting zone;
(b) an upwardly directional ice transport means comprising an upwardly inclined tube and an auger positioned in said tube along the axis thereof said auger being driven by a motor, said transport means being operably positioned at substantially the lowest portion of said ice collecting zone and
(c) an ice bagging zone positioned below an upper terminal end of said ice transport means and
(d) a water drain positioned on said tube at substantially the lowest point thereof.

14. The ice bagging apparatus according to claim 13 wherein said collecting zone comprises a funnel shaped structure.

15. The ice bagging apparatus according to claim 14 wherein said funnel and said tube are connected.

16. The ice bagging apparatus according to claim 15 wherein said tube terminates in said bagging zone.

17. The ice bagging apparatus according to claim 13 wherein said tube terminates in said bagging zone.

18. The ice bagging apparatus according to claim 17 wherein a removable closure is positioned at the lower end of said tube.

19. The ice bagging apparatus according to claim 17 wherein said motor is positioned at the upper end of said auger.

20. The ice bagging apparatus according to claim 17 wherein said motor is positioned at the lower end of said auger.

21. An ice bagging apparatus comprising:
(a) an ice collecting zone;
(b) an upwardly directional ice transport means operably positioned at substantially the lowest portion of said ice collecting zone and
(c) an ice bagging zone positioned below an upper terminal end of said ice transport means wherein said ice bagging zone comprises a tractor movably positioned between an upper terminal end of said ice transport means and a weight sensing closure, said tractor having a suction surface, alignable with a supply of bags for grasping and deploying a bag on said closure and below said upper terminal end.

22. The ice bagging apparatus according to claim 21 wherein said ice transport means comprises an upwardly inclined tube.

23. The ice bagging apparatus according to claim 22 wherein said ice transport means comprises an auger position in tube along the axis thereof.

24. The ice bagging apparatus according to claim 23 wherein said auger is driven by a motor.

25. The ice bagging apparatus according to claim 24 wherein a water drain is positioned on said tube at substantially the lowest point thereof.

26. The ice bagging apparatus according to claim 25 wherein said tube terminates in said bagging zone.

27. The ice bagging apparatus according to claim 26 wherein said motor is positioned at the upper end of said auger.

28. The ice bagging apparatus according to claim 26 wherein a removable closure is positioned at the lower end of said tube.

29. The ice bagging apparatus according to claim 28 wherein said collecting zone comprises a funnel shaped structure.

30. The ice bagging apparatus according to claim 29 wherein said funnel and said tube are connected.

31. The ice bagging apparatus according to claim 22 wherein said supply of bags is positioned in said bagging zone in a removable cassette.

32. The ice bagging apparatus according to claim 26 wherein said motor is positioned at the lower end of said auger.

* * * * *

US005109651C1

(12) EX PARTE REEXAMINATION CERTIFICATE (7616th)

United States Patent

Stuart

(10) Number: US 5,109,651 C1

(45) Certificate Issued: Jul. 20, 2010

(54) ICE BAGGER

(75) Inventor: James F. Stuart, Houston, TX (US)

(73) Assignee: Reddy Ice Corporation, Dallas, TX (US)

Reexamination Request:
No. 90/010,643, Aug. 12, 2009
No. 90/010,920, Mar. 18, 2010

Reexamination Certificate for:

| | |
|---|---|
| Patent No.: | **5,109,651** |
| Issued: | **May 5, 1992** |
| Appl. No.: | **07/593,046** |
| Filed: | **Oct. 5, 1990** |

(51) Int. Cl.
*B65B 5/06* (2006.01)
*B65B 63/08* (2006.01)

(52) U.S. Cl. ..... 53/502; 53/167; 53/573; 62/344

(58) Field of Classification Search ..... 53/167, 53/502, 573; 62/344
See application file for complete search history.

(56) References Cited

U.S. PATENT DOCUMENTS

| | | | |
|---|---|---|---|
| 2,116,300 | A | 5/1938 | Campos |
| 2,584,726 | A | 2/1952 | McOmber |
| 3,498,020 | A | 3/1970 | Eppenberger |
| 3,559,424 | A | 2/1971 | Nelson |
| 3,610,482 | A | 10/1971 | Van Steenburhg, Jr. |
| 3,712,019 | A | 1/1973 | Lamka et al. |
| 3,719,307 | A | 3/1973 | Larson |
| 3,789,570 | A | 2/1974 | Mullins, Jr. |
| 3,807,193 | A | 4/1974 | McKenney |
| 3,822,866 | A | 7/1974 | Daester |
| 3,897,676 | A | 8/1975 | Membrino |
| 3,913,343 | A | 10/1975 | Rowland |
| 3,918,266 | A | 11/1975 | Gindy et al. |
| 3,969,909 | A | 7/1976 | Barto et al. |
| 3,974,625 | A | 8/1976 | Simmons |
| 3,977,851 | A | 8/1976 | Toya |
| 3,982,377 | A | 9/1976 | Vanderpool |
| 4,013,199 | A | 3/1977 | Brown |
| 4,074,507 | A | 2/1978 | Ruf |
| 4,132,049 | A | 1/1979 | Mullins, Jr. |
| 4,139,029 | A | 2/1979 | Geraci |
| 4,139,126 | A | 2/1979 | Krasner |
| 4,189,063 | A | 2/1980 | Matthiesen |
| 4,348,872 | A | 9/1982 | Hill |

(Continued)

FOREIGN PATENT DOCUMENTS

| | | |
|---|---|---|
| GB | 1459629 | 12/1976 |
| JP | H1-33455 | 10/1989 |
| JP | H2-41067 | 3/1990 |

OTHER PUBLICATIONS

Campbell, Richard E.; Request for *Ex Parte* Reexamination of U.S. Patent No. 5,109,651 to Stuart; filed Mar. 18, 2010 (14 pages).

Order Granting Request for *Ex Parte* Reexamination of U.S. Patent No. 5,109,651 to Stuart, mailed Mar. 31, 2010, Control. No. 90/010,920 (9 pages).

Hoshizaki Brochure (No Date) (12 pages).

Office Action mailed May 28, 1991, by the USPTO, regarding U.S. Appl. No. 07/593,046 (9 pages).

Notice of Allowance and Issue Fee Due mailed Dec. 11, 1991, by the USPTO, regarding U.S. Appl. No. 07/593,046 (2 pages).

*Primary Examiner*—Jimmy G Foster

(57) ABSTRACT

An ice bagging apparatus comprising an ice collecting zone, which has water drain, an auger position below and in communication with the ice collecting zone and in communication with a separated ice delivery and bagging zone. The ice delivery and bagging zone has a weight sensing bottom closure, and a tractor with a vacuum surface for grasping and deploying a bag on the closure positioned for receiving ice delivered from the auger. The ice bagging apparatus is combined with an ice making apparatus and a bagged ice storage zone.

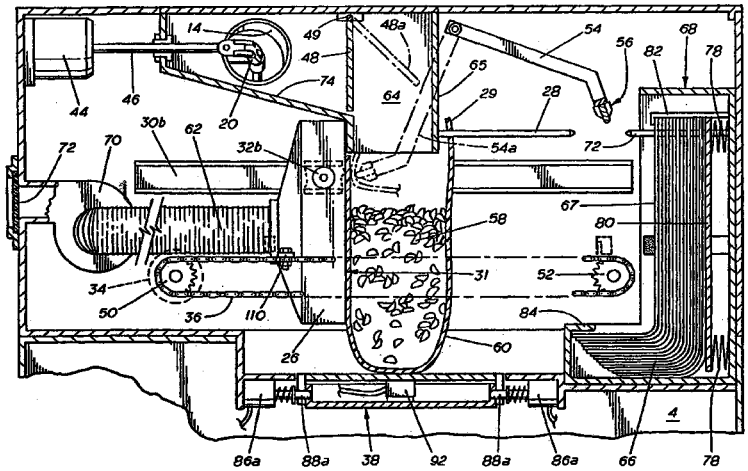

U.S. PATENT DOCUMENTS

| | | | | | |
|---|---|---|---|---|---|
| 4,350,004 | A | | 9/1982 | Tsujimoto et al. | |
| 4,368,608 | A | | 1/1983 | Ray | |
| 4,404,817 | A | | 9/1983 | Cox, III | |
| 4,409,763 | A | | 10/1983 | Rydeen | |
| 4,420,197 | A | | 12/1983 | Dreiling | |
| 4,461,520 | A | | 7/1984 | Alneng | |
| 4,534,155 | A | * | 8/1985 | Sawa et al. | 53/459 |
| 4,612,779 | A | | 9/1986 | Hatton | |
| 4,689,937 | A | | 9/1987 | Finan, Sr. et al. | |
| 4,903,494 | A | | 2/1990 | Wigley | |
| 4,909,696 | A | | 3/1990 | Wigley | |
| 4,942,983 | A | | 7/1990 | Bradbury | |
| 5,027,610 | A | | 7/1991 | Hara | |
| 5,070,798 | A | * | 12/1991 | Jurgens | 110/110 |
| 5,079,897 | A | | 1/1992 | Muller | |
| 5,088,300 | A | | 2/1992 | Wessa | |
| 5,108,590 | A | | 4/1992 | DiSanto | |
| 5,109,651 | A | | 5/1992 | Stuart | |
| 5,112,477 | A | | 5/1992 | Hamlin | |
| 5,211,030 | A | | 5/1993 | Jameson | |
| 5,277,016 | A | | 1/1994 | Williams et al. | |
| RE34,533 | E | | 2/1994 | Wigley | |
| 5,440,863 | A | | 8/1995 | Toya et al. | |

* cited by examiner

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 6 is confirmed.
Claims 1-3, 5 and 7-32 are cancelled.
Claim 4 was not reexamined.

* * * * *